US006007183A

United States Patent [19]

Horine

[11] Patent Number: 6,007,183

[45] Date of Patent: Dec. 28, 1999

[54] ACOUSTIC METAL JET FABRICATION USING AN INERT GAS

[75] Inventor: David A. Horine, Los Altos, Calif.

[73] Assignee: Xerox Corporation, Stamford, Conn.

[21] Appl. No.: 08/977,819

[22] Filed: Nov. 25, 1997

[51] Int. Cl.[6] ..... B41J 2/135

[52] U.S. Cl. ..... 347/46; 427/565; 427/600; 75/335

[58] Field of Search ..... 347/46, 44; 427/565, 427/600; 75/335

[56] References Cited

U.S. PATENT DOCUMENTS

| | | | |
|---|---|---|---|
| 4,308,547 | 12/1981 | Lovelady et al. | 346/140 R |
| 4,697,195 | 9/1987 | Quate et al. | 346/140 R |
| 5,041,849 | 8/1991 | Quate et al. | 346/140 R |
| 5,121,141 | 6/1992 | Hadimoglu et al. | 346/140 R |
| 5,266,098 | 11/1993 | Chun et al. | 75/335 |
| 5,520,715 | 5/1996 | Oeftering | 75/335 |
| 5,565,113 | 10/1996 | Hadimioglu et al. | 216/2 |
| 5,591,490 | 1/1997 | Quate | 427/457 |
| 5,608,433 | 3/1997 | Quate | 347/37 |

FOREIGN PATENT DOCUMENTS

| | | |
|---|---|---|
| 0 682 988 A1 | 11/1995 | European Pat. Off. . |
| WO 97/09125 | 3/1997 | WIPO . |

*Primary Examiner*—Richard Moses
*Attorney, Agent, or Firm*—Nola Mae McBain

[57] ABSTRACT

A method for manufacturing metal structures in which minute drops of a liquid metal are emitted from an acoustic device through an inert gas. The presence of the inert gas at the surface of the liquid metal prevent the formation of an oxide skin which would absorb acoustic energy and hinder droplet formation and emission. The droplets are then emitted towards a substrate, which may form as a carrier, where they may be used to form solder bumps, circuit traces, or accreted to form a three dimensional device.

2 Claims, 2 Drawing Sheets

ACOUSTIC METAL JET FABRICATION USING AN INERT GAS

INCORPORATION BY REFERENCE

The following U.S. patents are fully incorporated by reference:

- U.S. Pat. No. : 4,308,547 titled "Liquid Drop Emitter" by Lovelady et al., issued Dec. 29$^{th}$, 1981,
- U.S. Pat. No. 4,697,195 titled "Nozzleless Liquid Droplet Ejectors", by Quate et. al., issued Sep. 29$^{th}$, 1987,
- U.S. Pat. No. 5,041,849 titled "Multi-Discrete-Phase Fresnel Acoustic Lenses and their Application to acoustic In Printing" to Quate et al., issued Aug. 20$^{th}$, 1991;
- U.S. Pat. No. 5,121,141 titled "Acoustic In Printhead With Integrated Liquid Level Control Layer" to Hadimioglu et al., issued Jun. 9$^{th}$, 1992,
- U.S. Pat. No. 5,608,433 titled "Fluid Application Device and Method of Operation" by Quate issued Mar. 4$^{th}$, 1997,
- U.S. Pat. No. 5,591,490 titled "Acoustic Deposition of Material Layers" by Quate issued Jan. 7$^{th}$, 1997,
- U.S. Pat. No. 5,565,113 titled "Lithographically Defined Ejection Units" by Hadimioglu etl al., issued Oct. 15$^{th}$, 1996 and
- U.S. Pat. No. 5,520,715 titled "Directional Electrostatic Accretion Process Employing Acoustic Droplet Formation" by Oeftering issued May 28$^{th}$, 1996.

BACKGROUND

The present invention is directed to a method and apparatus for manufacturing three dimensional products. Some of the familiar prior art techniques for creating such products include, casting, extrusion, stereolithography and powder metallurgy. After the initial product is formed in the prior art, forming techniques, extractive techniques, chemical etching and additive or deposition techniques are often also performed to bring the product to final form.

Casting is usually performed by pouring a liquid, such as molten metal or plastic, into a mold and letting it cool and solidify. The metal takes the shape of the mold's interior surface as it solidifies. In extrusion semi-molten or molten plastic or hot metal is forced through an extrusion die which has a predetermined two dimensional shape. The extruded material takes the shape of the die and the shape of the die is transferred to the product through contact. In powdered metallurgy a batch of solid metal particles or powder is introduced into a mold where high temperature and pressure are applied to fuse or sinter the particles together. As is the case with casting, the end product assumes the shape of the mold's interior surface. In stereolithography an object is made by solidifying superposed layers of curable plastic resin until the complete object is built up.

After these initial objects are produced, forming techniques, extractive techniques, chemical etching, and additive or depositive techniques are often used to bring the product to the final form. Additional manufacturing techniques for making such objects include creating the products out of preformed component parts which are then joined by welding, soldering or brazing, or gluing.

However, many of these techniques have disadvantages. The molded form technique requires the mold be manufactured before the intended end product can be produced. In extractive techniques, much of the material is discarded causing waste of production materials. Metal fabrication by welding, soldering and brazing requires that the component parts be preformed before the final joining operation. In stereolithography individual layers may change their volume when solidifying causing stresses and deformation in the resultant product and materials are limited to a few plastic resins. In addition the specialized facilities needed for manufacturing are bulky and expensive.

A directional electrostatic accretion process employing acoustic droplet formation has been described in U.S. Pat. No. 5,520,715 by Oeftering, issued May 28, 1996 which addresses some of these issues. The process uses acoustically formed charged droplets of molten metal which are controlled by an acceleration electrode and deflection plates to build up a three dimensional product on a target substrate. The system is precisely controlled by a design workstation which has the parameters of the product to be built to insure the accuracy of the trajectory of each charged droplet. This process is certainly an improvement over prior processes because it requires less equipment that need not be retooled for every product desired to be reproduced, but it is limited in use because it must be operated in a vacuum or oxygen free atmosphere to eliminate the formation of an oxide skin on the free surface of the liquid metal. Formation of an oxide skin can impede ejection of metal droplets and absorb acoustic energy.

An oxygen free atmosphere can be created two ways, either operating in the vacuum of space or by enclosing the entire apparatus. Enclosing the apparatus requires additional large and complex machinery. Additionally, maintaining a precise depth of the pool of molten metal when the device is placed in a vacuum requires additional process steps not necessary when such a device is used in an atmospheric environment. Conventional displacement devices have been shown to be unreliable when used in a vacuum unoppsed by some external pressure means. Therefore the pool depth must be monitored and regulated using displacement means or an acoustic radiation pump.

It would therefore be desirable to build a manufacturing device, which requires fewer bulky parts, does not require retooling for each new part and which is capable of building three dimensional parts out of molten metal but which does not require the apparatus to be operated in a vacuum or an oxygen free atmosphere.

Further advantages of the invention will become apparent as the following description proceeds.

SUMMARY OF THE INVENTION

Figure 1:
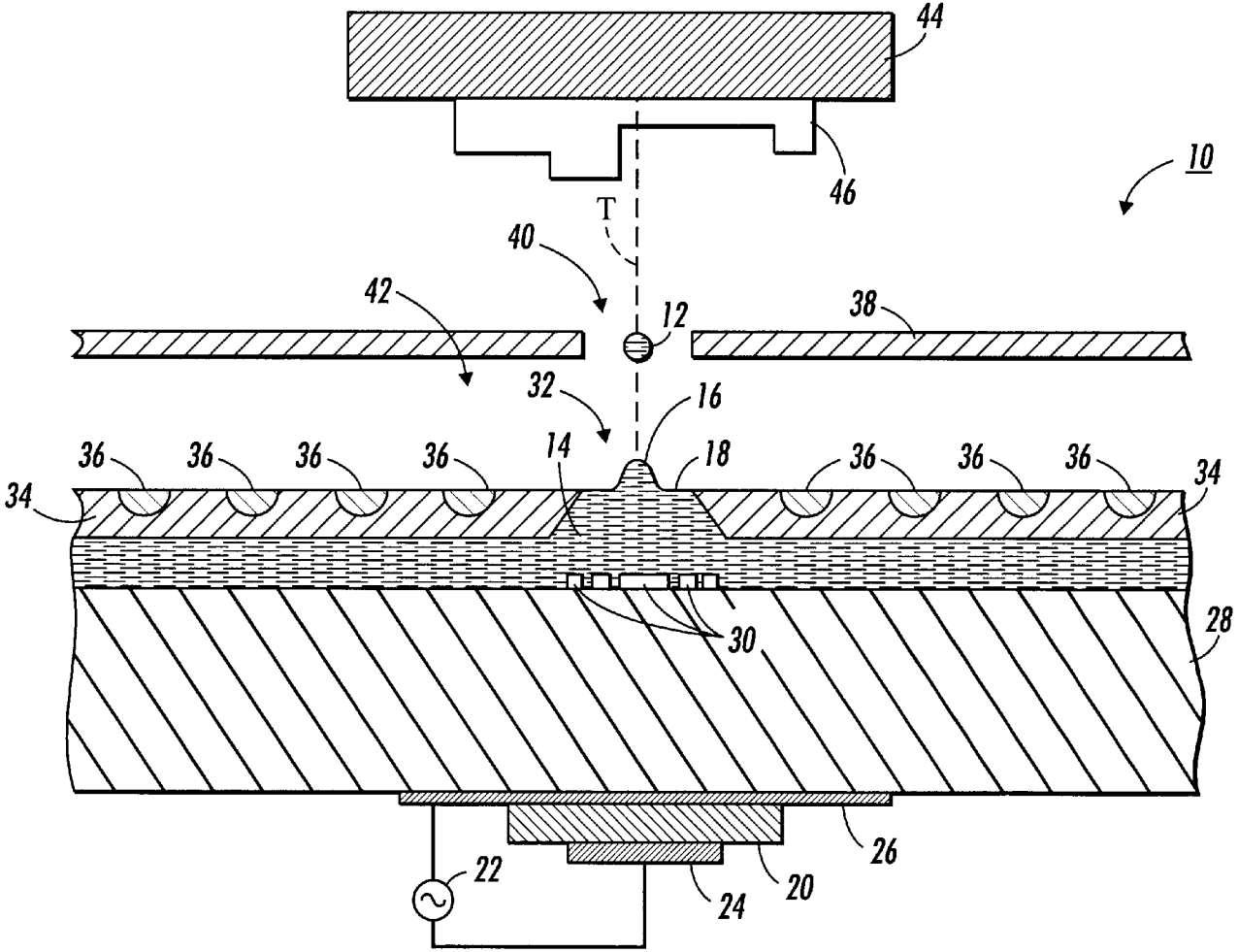
FIG. 1 shows a cross sectional view of a device which generates liquid droplets using focussed acoustic energy according to the present invention.

While the present invention will be described in connection with a preferred embodiment and method of use, it will be understood that it is not intended to limit the invention to that embodiment and procedures. On the contrary, it is intended to cover all alternatives, modifications and equivalents as may be included within the spirit and scope of the invention as defined by the appended claims.

ALPHA-NUMERIC LIST OF ELEMENTS

T trajectory
10 droplet emitter
12 droplet
14 liquid metal
16 mound
18 free surface of liquid
20 transducer
22 RF source
24 bottom electrode
26 top electrode
28 base
30 acoustic lens
32 opening
34 top fluid containment plate
36 heaters
38 top gas containment plate
40 opening
42 inert gas
44 substrate
46 solid structure
48 circuit board or electronic part
50 solder bumps

DETAILED DESCRIPTION OF THE INVENTION

Turning now to FIG. 1 a device which generates liquid droplets using focussed acoustic energy is shown. Such devices are known in the art for use in printing applications. Detailed descriptions of acoustic droplet formation and acoustic printing can be found in the following U.S. patent applications: U.S. Pat. No. 4,308,507 titled "Liquid Drop Emitter" by Lovelady et al., issued Dec. 29$^{th}$, 1981, U.S. Pat. No. 4,697,195 titled "Nozzleless Liquid Droplet Ejectors", by Quate et. al., issued Sep. 29$^{th}$, 1987, U.S. Pat. No. 5,041,849 titled "Multi-Discrete-Phase Fresnel Acoustic Lenses and their Application to acoustic In Printing" to Quate et al., issued Aug. 20$^{th}$, 1991; U.S. Pat. No. 5,121,141 titled "Acoustic In Printhead With Integrated Liquid Level Control Layer" to Hadimioglu et al., issued Jun. 9$^{th}$, 1992, U.S. Pat. No. 5,608,433 titled "Fluid Application Device and Method of Operation" by Quate issued Mar. 4$^{th}$, 1997, all herein incorporated by reference, as well as other patents.

The most important feature of the device shown in FIG. 1 is that it does not use nozzles and is therefore unlikely to clog, especially when compared to other methods of forming and ejecting small, controlled droplets. The device can be manufactured using photolithographic techniques to provide groups of densely packed emitters each of which can eject carefully controlled droplets. Furthermore, it is known that such devices can eject a wide variety of materials, U.S. Pat. No. 5,591,490 titled "Acoustic Deposition of Material Layers" by Quate issued Jan. 7$^{th}$, 1997 and herein incorporated by reference, describes a method for using an array of such acoustic droplet emitters to form a uniform layer of resist, U.S. Pat. No. 5,565,113 titled "Lithographically Defined Ejection Units" by Hadimioglu etl al., issued Oct. 15$^{th}$, 1996, and herein incorporated by reference, states that the principles of acoustic printing are suitable for ejection of materials other than marking fluids, such as mylar catalysts, molten solder, hot melt waxes, color filter materials, resists, chemical compounds, and biological compounds. U.S. Pat. No. 5,520,715 titled "Directional Electrostatic Accretion Process Employing Acoustic Droplet Formation" by Oeftering issued May 28$^{th}$, 1996, and herein incorporated by reference describes using focussed acoustic energy to emit droplets of liquid metal.

With the above concepts firmly in mind, the operation of an exemplary acoustic droplet emitter, according to the present invention, will now be described. There are many variations in acoustic droplet emitters and the description of a particular droplet emitter is not intended to limit the disclosure but to merely provide an example from which the principles of acoustic droplet generation in this inventions particular context can be understood.

FIG. 1 shows an acoustic droplet emitter 10 shortly after emittion of a droplet 12 of a liquid metal 14 and before a mound 16 on a free surface 18 of the liquid metal 14 has relaxed. The forming of the mound 16 and the subsequent ejection of the droplet 12 is the result of pressure exerted by acoustic forces created by a ZnO transducer 20. To generate the acoustic pressure, RF energy is applied to the ZnO transducer 20 from an RF source via a bottom electrode 24 and a top electrode 26. The acoustic energy from the transducer 20 passes through a base 28 into an acoustic lens 30. The acoustic lens 30 focuses its received acoustic energy into a small focal area which is at or very near the free surface 18 of the liquid metal 14. Provided the energy of the acoustic beam is sufficient and properly focused relative to the free surface 18 of the liquid 14, a mound 16 is formed and a droplet 12 is subsequently emitted on a trajectory T.

The liquid metal 14 is contained by a top plate 34 which has a opening 32 in which the free surface 18 of the liquid 14 is present and from which the droplet 12 is emitted. The liquid 14 metal flows beneath the top fluid containment plate 34 and past the acoustic lens 30 without disturbing the free surface 18. Heaters 36 are provided in the top fluid containment plate to insure proper temperature control and liquidity of the liquid metal 14.

The opening 32, in the top fluid containment plate 34, is many times larger than the drop 12 which is emitted thereby greatly reducing clogging of the opening, especially as compared to other droplet ejection technologies. It is this feature of the droplet emitter 10 which makes its use desirable for emitting droplets of a wide variety of materials. Also important to the invention is the fact that droplet size of acoustically generated and emitted droplets can be precisely controlled. Drop diameters can be as small as 16 microns allowing for the deposition of very small amounts of material.

Also present in the droplet emitter 10 is a top gas containment plate 38 with an opening 40 which is aligned with the opening 32 in the top fluid containment plate 34. Opening 40 in the top gas containment plate 38 need not be as large as opening 32 in the top fluid containment plate. Opening 40 in the top gas containment plate 38 need only be large enough for the emitted droplet 12 to pass through unobstructed. A continuously flowing inert gas 42 flows through the space created between the top fluid containment plate 34 and the top gas containment plate 38. The inert gas 42 needs only to flow with some positive pressure. It is desirable to keep the flow rate as low as possible to avoid disturbing the trajectory T of the emitted droplet 12 at approximately 4 m/sec. Flow rates of approximately 0.5 m/sec or less should be sufficient to provide a continuous flow of inert gas 42 without disturbing the trajectory T of the emitted droplet 12. By inert gas, what is meant is a gas that will not react with the free surface 18 of the liquid metal 14. Examples of such gasses include argon, zenon, krypton or nitrogen, although any such gas is appropriate. If the inert gas 42 were not present, then oxygen in the atmosphere would react with the free surface 18 of the liquid to form an oxide skin which would absorb acoustic energy and impede the emission of droplets 12 from the droplet emitter 10. The mound 16 and the droplet 12 are formed in the presence of the inert gas 42. The droplet 12 is then emitted through the opening 40 in the top gas containment plate 38 along the trajectory T towards the substrate 44, forming a solid structure 46 on the substrate 44.

It should be noted that the inert gas 42 will bleed slightly through the opening 40 in the top gas containment plate 42. If the substrate 44 is placed in close proximity to the droplet emitter 10, then the gap between the substrate 44 and the droplet emitter 10 should be at least partially filled with inert gas 42 due to the bleeding of the inert gas 42 though the opening 40 in the top gas containment plate 38. The maximum recommended distance between the droplet emitter 10 and the substrate 44 or the surface of the solid structure 46 is approximately 1 mm.

The solid structure 46 is built up in three dimensions by emitting successive layers of droplets 12. This can be accomplished by either moving the substrate 44 while maintaining droplet emitter 10 as fixed, moving droplet emitter 10 while maintaining the substrate 44 as fixed or moving both substrate 44 and droplet emitter 10. As the layers build up to form solid structure 46, it may be necessary to adjust the positioning of the substrate 44 to provide more distance between the substrate 44 and the droplet emitter 10. This is to compensate for build-up of solid structure 46 and maintain a preferred distance between the droplet emitter 10 and either substrate 44 or solid structure 46. Again this can be accomplished by either moving the substrate 44 while maintaining droplet emitter 10 as fixed, moving droplet emitter 10 while maintaining the substrate 44 as fixed or moving both substrate 44 and droplet emitter 10.

While a variety of liquified metals might be used, one example particularly suited for this process is any of the varieties of solder. For example, a solder made up of 63% tin and 37% lead has a melting point of only 183 degrees centigrade. The low melting points of solders makes them especially suited for this type of application.

In practice, the individual droplet emission of liquid metals can be used in various applications. Shown in FIG. 1, is the application of building three dimensional metal structures. The structure can either be formed from the desired metal needed for a particular part or formed from a metal that has a low melting point, such as the solders mentioned above, and used as an investment casting for high melting point alloys. The advantage to making investment castings from this process is that investment castings with very fine details can be made due to the small droplet size, about 16 microns in diameter, obtainable with this process.

Figure 2:
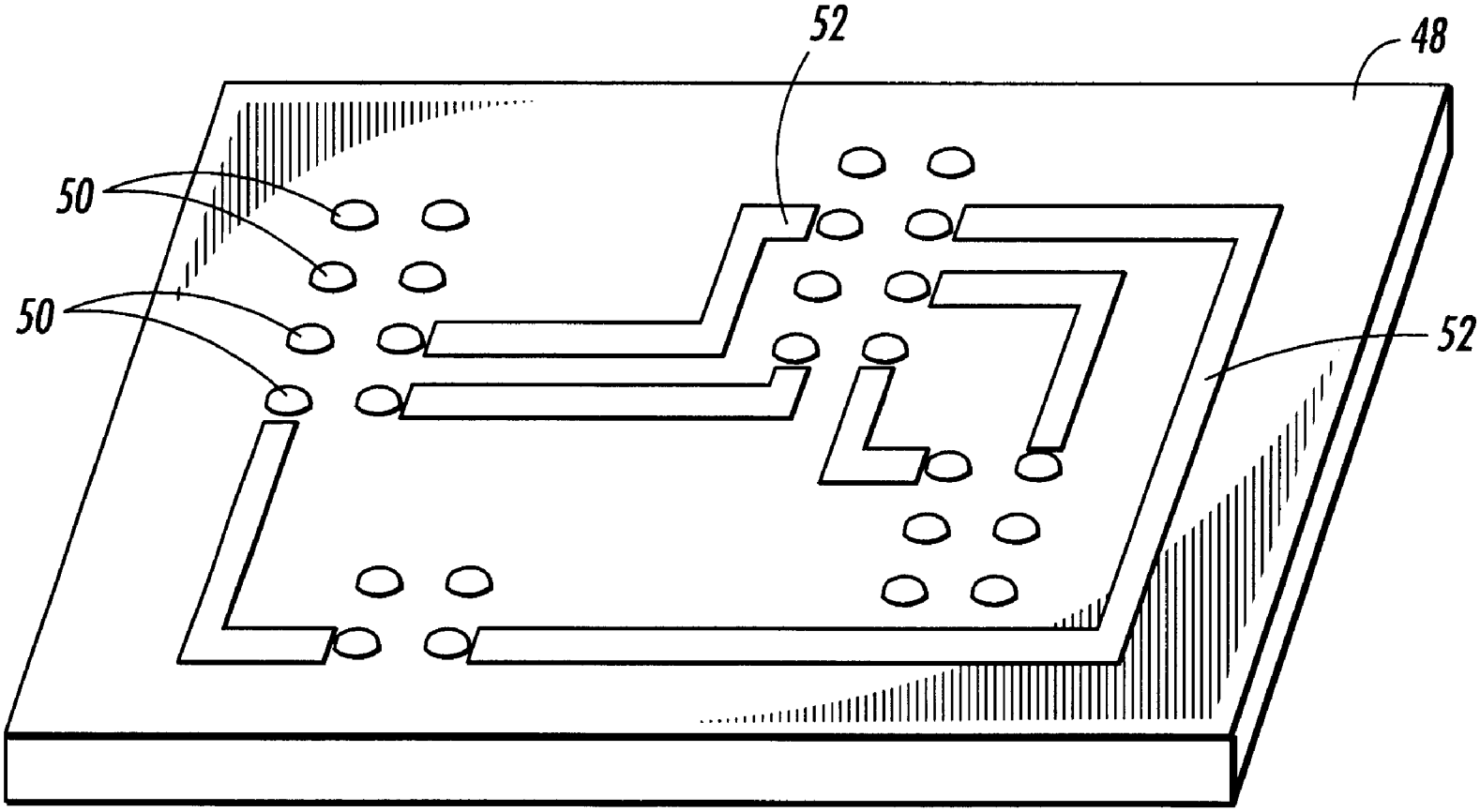
FIG. 2 shows a perspective view of a product made using the present invention.

An alternative product is shown in FIG. 2. FIG. 2 is a perspective view of a circuit board or electronic part 48 which has a plurality of solder bumps 50. Solder bumps are often used as a means of joining integrated circuits to substrates. The droplet emitter 10 shown in FIG. 1 has the unique ability to consistently and reliably deliver measured droplets to a particular destination making it especially suitable to manufacture solder bumps. Either a single droplet 12 or a small multiple number of droplets 12 can be emitted to a particular location to form a solder bump as shown in FIG. 2.

Also shown in FIG. 2 are metal interconnect lines 52. Again because of the ability of droplet emitter 10 to deliver measured droplets in a variety of conceivable patterns, droplet emitter 10 is especially suited for this type of manufacturing.

I claim:

1. A device for emitting liquid metal droplets on demand from a free surface of a liquid pool comprising:

a) a solid substrate having first and second surfaces, and having an acoustic focussing element on the first surface, b) acoustic wave generating means intimately coupled to the second surface of said solid substrate for generating rf acoustic waves such that the acoustic focussing element causes an acoustic beam to be focussed to converge near the free surface of the liquid pool, for forming droplets of the liquid, c) a top fluid control plate, having first and second surfaces, with the first surface in intimate contact with the liquid pool, said top fluid control plate have at least one opening therethrough, the opening being aligned with said acoustic wave generating means and the acoustic focussing element such that the acoustic beam focussed near the free surface of the pool will be focussed at least partly within the opening, the opening being large enough to permit droplets formed by the focussing of the acoustic beam at the free surface of the liquid to pass therethrough, d) a top gas containment plate have first and second surfaces to at least partially contain an inert gas between the first surface of the top gas containment plate and the second surface of the top fluid control plate, said top gas containment plate having at least one opening therethrough, the opening in the top gas containment plate being aligned with the opening in the top fluid control plate such that any liquid drops passing through the opening in the top fluid control plate may also pass through the top gas containment plate.

2. The device for emitting liquid metal droplets on demand from a free surface of a liquid pool of claim 1 wherein the opening in the top gas containment plate is approximately one-half the size of the opening of the opening in the top fluid control plate.

* * * * *